United States Patent [19]

Michaels

[11] 3,947,912

[45] Apr. 6, 1976

[54] MANUALLY OPERATED SWEEPER

[76] Inventor: Abraham Michaels, 638 Spruce St., Philadelphia, Pa. 19106

[22] Filed: Sept. 13, 1974

[21] Appl. No.: 505,854

[52] U.S. Cl. ..... 15/79 R; 56/400.02

[51] Int. Cl.[2] ..... E01H 1/04

[58] Field of Search ..... 15/79, 83, 42; 56/400.02

[56] References Cited

UNITED STATES PATENTS

| | | | |
|---|---|---|---|
| 581,196 | 4/1897 | Conselyea | 15/79 |
| 593,086 | 11/1897 | Duross | 15/79 |
| 667,132 | 1/1901 | Kimball | 15/79 |
| 684,812 | 10/1901 | Haerst | 15/79 |
| 810,547 | 1/1906 | Menzies | 15/79 |
| 1,232,294 | 7/1917 | Hagerty | 15/79 |

*Primary Examiner*—Edward L. Roberts

*Attorney, Agent, or Firm*—Weiser, Stapler & Spivak

[57] ABSTRACT

A manually operated mechanical street cleaning apparatus comprising a wheeled frame suitable to retain a trash container thereon. A height adjustable axle mounted rotary broom is mounted forwardly of the frame and is rotated by action of ground contacting wheels through a suitable drive mechanism when the vehicle is moved. The rotary brush sweeps into a rearwardly positioned hopper which is adapted to be pivoted to a dumping position to empty the swept debris into the trash container. In an embodiment of the device, the wheeled vehicle is propelled by an attached, manually actuated bicycle which is laterally affixed to the vehicle.

24 Claims, 9 Drawing Figures

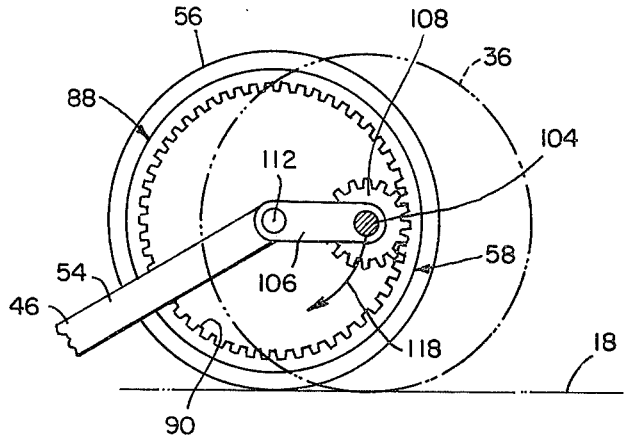
FIG. 6
FIG. 5
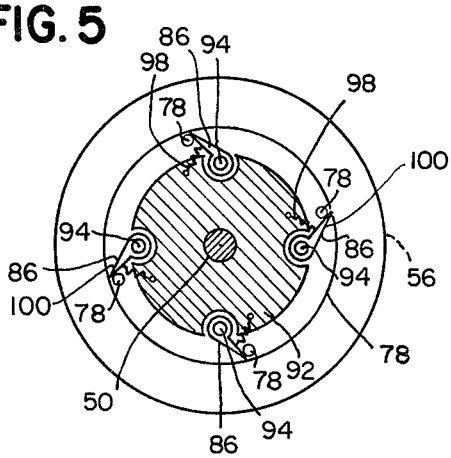
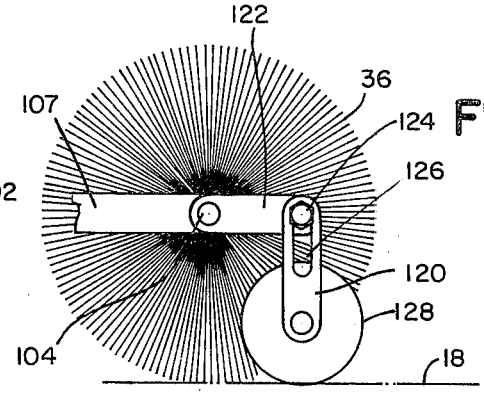
FIG. 7
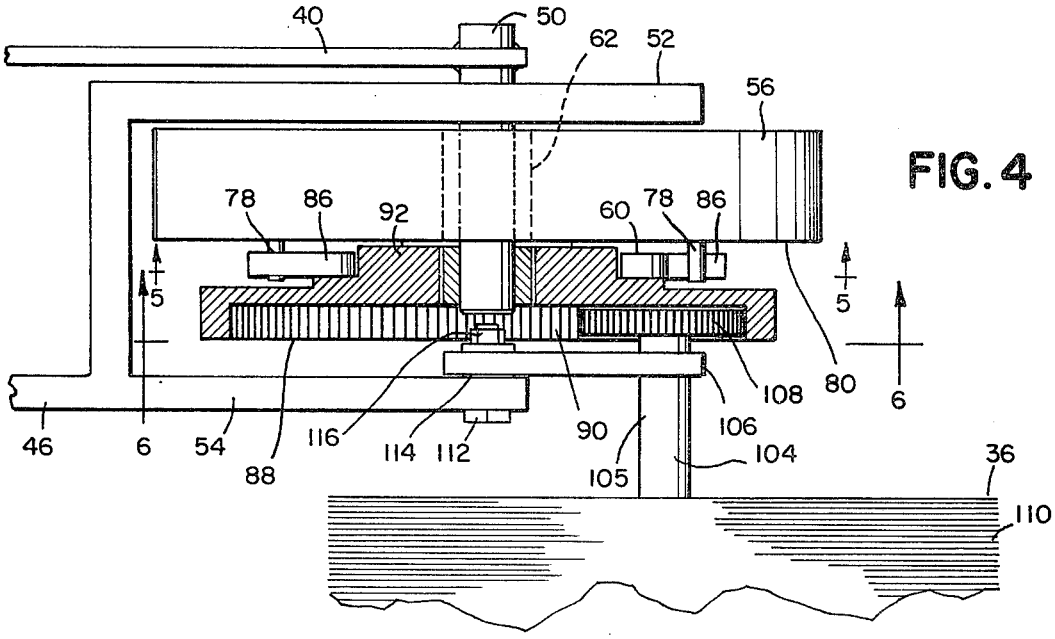
FIG. 4

MANUALLY OPERATED SWEEPER

BACKGROUND OF THE INVENTION

The present invention relates generally to the art of surface cleaning, and more particularly, is directed to a manually operated type of mechanical surface cleaning apparatus.

The present apparatus finds utility for cleaning sidewalks, walkways, streets, the interior of large buildings, garages, institutions, warehouses, factories and similar places. The device is used to remove dirt, litter, leaves and other loose material from areas generally served by street cleaners, custodial personnel, professional cleaning organizations, etc. At the present time, it is the usual practice when cleaning public highways to employ large, costly, motor driven vehicles which have rotary brushes and/or vacuum producers attached and which usually incorporate some type of spray apparatus for dust control purposes. These large vehicles are generally satisfactory but are quite costly in initial capital outlay and are also costly in operation. Such vehicles require the services of one or two employees and additionally utilize large quantities of fuel such as gasoline during the daily cleaning operation. Such vehicles are noisy and emit polluting gases.

Such vehicles have found wide employment in those instances wherein it is desirable or necessary to clean large numbers of streets within a relatively short period of time. In addition to the drawbacks above mentioned, the large mechanically operated cleaning vehicles have been found generally unsuitable for congested areas such as the business sections of large cities wherein the amount of traffic usually present renders it extremely difficult to economically employ such large vehicles. Additionally, in such congested areas, the large cleaning vehicles present a real hazard to pedestrians who are generally present in great numbers. Under such conditions, it has generally been the practice to employ hand sweepers, that is, men specially employed to sweep the streets by utilizing a hand broom. Such workers generally are additionally equipped with a wheeled cart which holds a trash container thereon. Thus, a sweeper must first manually sweep accumulated dirt into a pile and then somehow lift the pile into the container. This process is repeated time and time again until the container is full and must be taken to a point of disposal. It will be remembered that two complete separate operations are thus required from a single worker, namely, first to sweep the dirt by employing a hand broom and after the dirt has been swept into a pile, then to advance a wheeled cart so that the pile can be transferred into a trash container. These operations must necessarily be quite time consuming and require the sweeper to continually backtrack over the same ground for sweeping and container transporting purposes.

In the case of privately owned areas, such as sidewalks and other flat surfaces, mechanically operated smaller cleaning devices have been provided in the past, many of such vehicles being of the so-called vacuum cleaner type. These prior art cleaners have performed generally satisfactorily, but are objectionable in that they are noisy, that they consume energy and that they are costly to purchase.

SUMMARY OF THE INVENTION

This invention relates generally to the field of surface cleaning vehicles and more particularly is directed to a manually operated cart having associated therewith a rotary brush, a hopper and a large trash container.

The invention relates to a sweeper that is entirely manual in operation which may be either pedestrian motivated or cycle motivated to thereby provide an efficient sweeping machine capable of conserving energy resources and of reducing the noise level generally associated with mechanical surface cleaning devices. The sweeper of the present invention may be used on sidewalks, walkways, streets, large buildings, lots or any flat surface wherein it is desired to remove dirt, litter leaves, etc. Further, the sweeper of the present invention greatly increases the productivity of each individual manual worker.

The device of the present invention will operate with substantially less noise than all of the prior art motor driven units and will not use any fuel or stored power, thereby conserving energy resources. The device is semi-automatic in operation in that the forces employed in pushing the vehicle over a surface are also utilized to impart rotary motion to a cylindrical brush.

The sweeper comprises a frame which is suitably constructed to ride upon a plurality of wheels. The frame is designed to carry a large trash container which has adequate capacity to allow extended periods of use before emptying. A rotary, generally cylindrical, brush mounts forwardly of the frame and sweeps debris into a rearwardly positioned hopper as the vehicle is forwardly moved. the brush receives rotary power from ground contacting wheels through a gear drive and height adjustment means are preferably provided to compensate for brush wear. The hopper is mounted to be readily pivoted to dump the hopper contained debris directly into the large trash container.

In one embodiment of the invention, the vehicle is adapted with a handle to permit a worker to push the vehicle along a path for sweeping purposes. Thus, as the vehicle is guided by the worker, the cylindrical brush acts to automatically sweep the debris into the hopper which can then be manually pivotally dumped into the trash container at suitable intervals. In a second embodiment, the vehicle is provided with laterally extending support arms which attach to a cycle to thereby increase the speed of operation by means of a bicycle type of conveyance. In another embodiment, the brush is provided with a transversely extending, cantilevered shaft which cantilevers transversely outwardly from one of the wheels to facilitate sweeping into hard-to-reach areas, such as street gutter or immediately alongside the walls of buildings.

It is therefore an object of the present invention to provide an improved, manually operated sweeper of the type set forth.

It is another object of the present invention to provide a novel manually operated sweeper capable of greatly increasing the work output of an individual worker.

It is another object of the present invention to provide a novel manually operated sweeper including a hand pushed vehicle incorporating a manually propelled broom at the front end thereof.

It is another object of the present invention to provide a novel manually operated sweeper which includes a wheeled vehicle and a rotary brush powered by a wheel connected drive, the brush serving to sweep debris into a hopper and wherein the hopper is pivotally arranged to dump debris from the hopper into a trash container carried by the vehicle.

It is another object of the present invention to provide a novel manually operated sweeper which is capable of greatly increased productivity and which operates without the use of motor driven vehicles, power driven sweepers or vacuum devices.

It is another object of the present invention to provide a novel manually operated sweeper including a wheeled vehicle, a rotary brush which is driven from a surface contacting wheel, a hopper receiving debris which is swept by the brush and means to conveniently empty the hopper into a trash container at desired intervals.

It is a further object of the present invention to provide a manually operated sweeper including a replaceable broom element and means to vary the elevation of the broom element.

It is a further object of this invention to provide a manually operated sweeper that is inexpensive in manufacture, trouble-free when in use and capable of greatly increasing the production of a worker.

Other objects and a fuller understanding of the invention will be had by referring to the following description and claims of the preferred embodiment thereof, taken in conjunction with the accompanying drawings, wherein like reference characters refer to similar parts throughout the several views, end in which:

BRIEF DESCRIPTION OF THE DRAWINGS

FIG. 4 is an enlarged, partial, top plan view of the brush drive connection to a ground contacting wheel and partially in section to expose details of interior construction.

FIG. 5 is a cross sectional view taken along Line 5—5 of FIG. 4, looking in the direction of the arrows.

FIG. 6 is a cross sectional view taken along Line 6—6 of FIG. 4, looking in the direction of the arrows.

FIG. 7 is a cross sectional view taken along Line 7—7 of FIG. 9, looking in the direction of the arrows.

DESCRIPTION OF THE PREFERRED EMBODIMENT OF THE INVENTION

Figure 1:
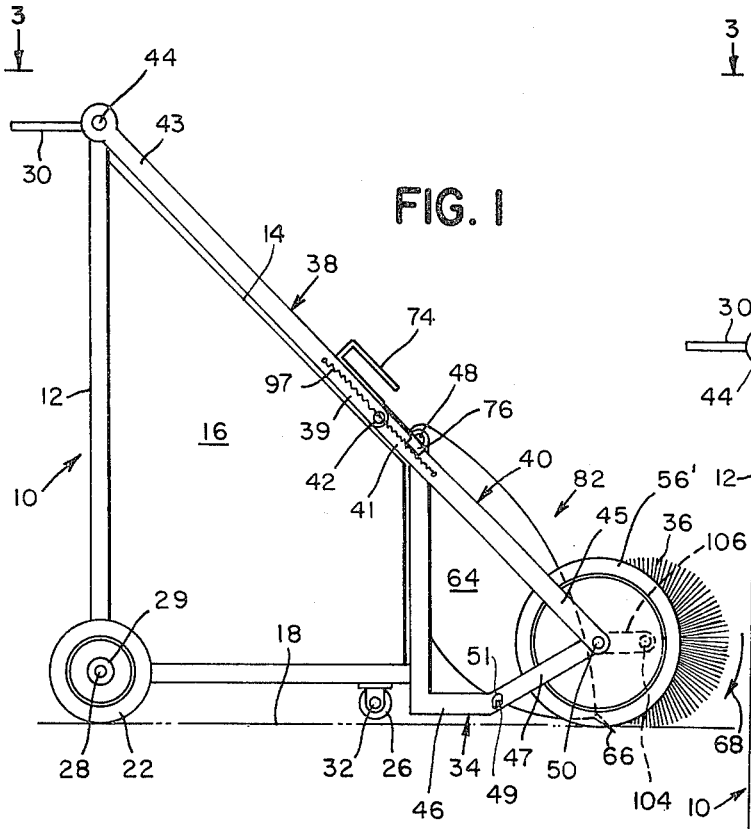
FIG. 1 is a side elevational view of a manually operated sweeper in accordance with the present invention.

Although specific terms are used in the following description for the sake of clarity, these terms are intended to refer only to the particular structure of my invention selected for illustration in the drawings and are not intended to define or limit the scope of the invention.

Figure 2:
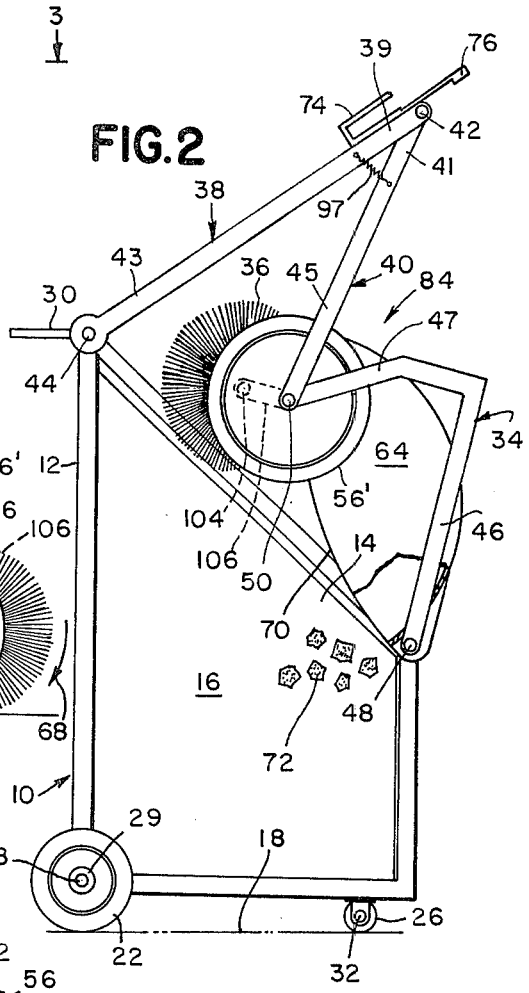
FIG. 2 is a view similar to FIG. 1 showing the brush and hopper in pivoted position.
Figure 3:
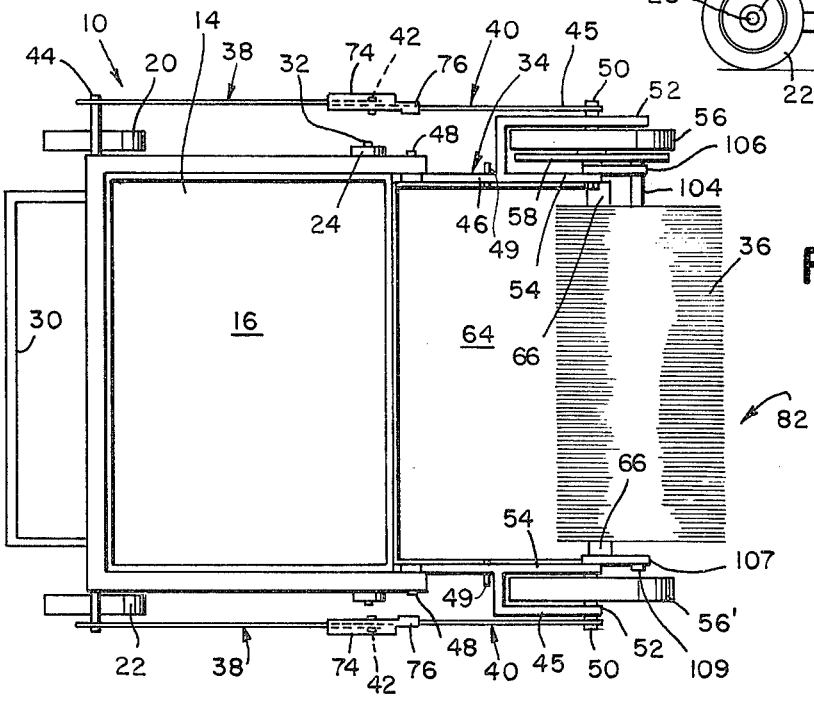
FIG. 3 is a top plan view of the sweeper as seen from Line 3—3 of FIG. 1, looking in the direction of the arrows.

Referring now to the drawings, I show in FIGS. 1–3 a wheeled, manually operated sweeper generally designated 10, which includes a carriage 12. The carriage 12 is fabricated of light-weight metal or plastic of conventional structural shapes such as tubes or angles to provide a frame assembly in a manner well known to those skilled in the art of metal or plastic fabrication. The carriage 12 defines an open interior area 14 into which is positioned a large trash container 16. The trash container may either be designed to be readily removable from the carriage 12 for dumping purposes or else the trash container can be securely affixed thereto and disposable bags (not illustrated) can be employed as trash container liners.

The carriage 12 is designed to be movable over a surface 18 and is fabricated to include a pair of laterally spaced rear wheels 20, 22 and a pair of laterally spaced front wheels 24, 26. A conventional rear axle 28 is affixed to the carriage 12 in a manner to rotatively carry the rear wheels 20, 22 by employing suitable bearings or bushings 29. Similarly, a front axle 32 is affixed to portions of the carriage 12 to rotatively carry the front wheels 24, 26 in conventional manner. Optionally, the front wheels 24, 26 can be of the individual caster type. A rigid handle 30 which may be fabricated of the same material as the carriage 12, is welded or otherwise securely affixed to the carriage at a comfortable elevation to permit a workman to conveniently push the sweeper 10 over a surface 18 for surface cleaning purposes.

A brush holding and pivoting linkage means 34 pivotally affixes to the carriage 12 and forwardly carries a surface contacting brush 36 in a rotary engagement. The sweeper 10 is provided with a pair of laterally opposed, similar linkage means 34, each of which includes an upper strut 38 and a lower strut 40. The lower end 39 of the upper strut 38 pivotally interconnects at the pivot pin 42 with the upper end 41 of the lower strut 40. The other end 43 of the upper strut 38 connects to the carriage 12 at the pin 44 and is pivotal thereabout. As best seen in FIGS. 1 and 2, the upper and lower struts 38, 40 are pivotally movable from a surface sweeping position 82 wherein the struts 38, 40 align in straight line relationship (FIG. 1) to a transport position 84 wherein the struts 38, 40 are positioned in angular relationship to each other (see FIG. 2). It will be noted that the brush 36 and the weight associated therewith is pivoted past the vertical when the struts 38, 40 and moved to the transport position. Accordingly, once in the transport position 84, the brush will remain in the transport position to thereby facilitate transport of the sweeper 10 when it is desired to move the sweeper from place to place without cleaning a surface. It should be noted that the vehicle 10 can be designed, if desired, to dump the hopper 64 without raising the wheels 56, 56' and the broom 36.

A bent strut 46 pivotally connects to the carriage 12 at the pivot pin 48 in a manner to be rotatable by pivot means in a counterclockwise direction relative to the carriage 12 when moving from the surface sweeping position 82 to the transport position 84. The wheel end 47 of the bent strut 46 interacts with the second end 45 of the lower strut 40 and the respective ends 45, 47 are pivotally joined to pivot at wheel axle 50. As best seen in FIGS. 3 and 4, the bent strut 46 is bifurcated at the wheel end 47 to form an outer leg 52 and an inner leg 54, the legs 52, 54 being spaced apart a sufficient distance to accommodate therebetween a ground contacting wheel 56, the brush rotating and gear mechanism 58, and the brush ratchet assembly 60. A suitable bushing 62 is conventionally provided between the axle 50 and the wheel 56 to facilitate substantially friction free rotation of the wheel 56 about the axle 50.

As best seen in FIGS. 1 and 3, the sub-assembly defined between the lower strut 40 and the bent strut 46 at each side of the carriage 12 defines a transverse interior space within which is mounted a hopper 64 which is positioned immediately behind the brush 36. The hopper 64 terminates forwardly in a surface contacting rubber or plastic lip 66 which is designed to permit easy replacement upon evidence of wear. The lip 66 projects downwardly a sufficient distance to engage the surface 18 as the sweeper 10 is moved along the surface. As the brush is rotated in the direction of the arrow 68, any dirt, debris or other loose material which may be present upon the surface 18 is urged by action of the brush 36 over the lip 66 and into the hopper 64.

When the hopper becomes sufficiently filled, the right and left pairs of upper and lower struts 38, 40 and the bent struts 46 are manually pivoted to the transport position 84 as illustrated in FIG. 2 wherein the open top 70 of the hopper 64 is urged past the vertical. When the parts may be pivoted to the transport position 84, all of the dirt and debris 72 falls by gravity from the hopper 64 into the trash container 16. As previously noted, the hopper 64 could be independently suspended so that the hopper could be dumped without raising the entire front frame including brush 36, wheels 56, 56' and the bent strut 34. This is accomplished by pivoting the hopper 64 about the pivot pin 48 to dump the contents of the hopper 64 into the trash container 16. The bottom of the hopper 64 is elevationally adjustable by providing a pair of transversely opposed brackets 49. The brackets 49 position within the elongated slots 51 which are formed in the brush holding and pivoting linkage means 34 to thereby easily control the elevation of the plastic lip 66 relative to the ground surface 18. Once the debris 72 has been dumped from the hopper 64, the struts 38, 40, 46 can then be again pivoted about the respective pivot pins 42, 44 and 48 and the wheel axle 50 in a clockwise direction to the sweeping position as illustrated in FIG. 1. As best seen in FIG. 2, a handle 74 and/or spring 97 may be affixed to each upper strut 38 near its lower end 39 connection to the lower strut 40 at the pin 42 to facilitate in moving the brush 36 and the hopper 64 from the sweeping position 82 of FIG. 1 to the transport position 84 of FIG. 2.

Additionally, I have found it desirable to provide a straight arm lock 76 as an extension to the upper strut 38, suitably equipped with a spring lock or sliding bolt (not shown) to lock the lower strut 40 in longitudinal alignment with the upper strut 38 for brush sweeping purposes. When moving the brush 36 and hopper 64 from the transport position 84 of FIG. 2 to the sweeping position 82 of FIG. 1, the lock 76 contacts the top of the lower strut 40 to prevent over pivoting and thereby serves to align and hold the upper and lower struts 38, 40 in straight line relationship. The lock 76 further prevents any relative pivotal movement of the struts 38, 40 beyond the straight line relationship as illustrated in FIG. 1. Thus, the pivot pin 42 can only travel upwardly from the position illustrated in FIG. 1 to the transport position 84 and it is impossible to rotate the lower struts 38 in a counterclockwise direction about the pin 42 when the parts are arranged in the sweeping position 82 of FIG. 1.

It is noteworthy that when the upper and lower struts 38, 40 are arranged in longitudinal alignment as in FIG. 1, the wheels 56, 56' contact the ground to provide frictional ground engagement for brush 36 rotational purposes. In this position, the frame front wheels 24, 26 do not contact the ground. As illustrated in FIG. 2, when the brush 36 moves to the transport position 84 with the upper and lower struts in contracted relationship, the front frame wheels 24, 26 contact the ground surface 18 for carriage transport purposes.

Referring now to FIGS. 4–6, the drive mechanism for rotating the brush 36 will now be described. As previously indicated, the wheel 56 freely rotates about the axle 50 through a bushing 62 or other conventional bearing arrangement. The wheel 56 contacts the surface 18 as the sweeper 10 is moved and accordingly is rotated about the axle 50 by action of the frictional contact between the periphery of the wheel 56 and the surface 18. A plurality of circularly spaced pins 78 affix to the wheel 56 and project inwardly from the inner surface 80 and interact with the rachet levers 86 for brush functioning purposes as hereinafter more fully set forth. A brush gear 88 turns about the wheel axle 50 and includes an internal gear tooth section 90 and a concentric hub section 92, which hub section 92 faces the inner surface 80 of the wheel 56. Optionally, other suitable rachet or clutch designs would be employed in a manner well known to those skilled in the art.

The rachet levers 86 are pivotally connected to the hub section 92 by rachet pivot pins 94. Springs 96 are associated with rachet pivot pins 94 and are arranged to continuously urge the rachet levers in a counterclockwise direction to the open, drive position as illustrated in FIG. 5. It will be noted that each rachet lever 86 is fabricated to provide a straight, locking surface 98 for engaging a pin 78 and a curved, cam surface 100 for passing a pin 78. Thus, when the sweeper 10 is moved forwardly to cause the wheels 56, 56' to rotate in a clockwise direction as indicated by the arrow 102, the action of the springs 96 causes the rachet levers 86 to pivot outwardly in a couterclockwise direction about the pivot pins 94. In this position, the locking surfaces 98 of the rachet levers 86 engage the pins 78 which project from the wheels 56. Accordingly, rotation of the wheels in the direction of the arrow 102 causes simultaneous rotation of the brush gear 88. Conversely, should the sweeper 10 be pulled backwardly, the wheel 56 will be rotated in a direction opposite to that indicated by the arrow 102. The curved cam surfaces 100 of each rachet lever 86 will strike a pin 78 in a manner to cause clockwise rotation of the levers 78 about their respective rachet pivot pins 94 against the bias of the springs 96. This arrangement allows the wheel 56 to slip relative to the brush gear 88, thereby causing no rotation of the brush 36.

Still referring to FIGS. 4–6, I show the brush 36 connected to a brush shaft 104. The brush shaft 104 is journalled between the right adjustable arm 106 and the left arm 107 and terminates at its right end 105 in a right pinion gear 108. The pinion gear 108 respectively meshes with the internal gear teeth 90 of the brush gear 88. Thus, when the brush gear 88 is turned by rotative action of the wheels 56 in the direction of the arrow 102 as hereinbefore set forth, the interaction of the brush gear 88 and the pinion gear 108 causes rotation of the brush 36 for surface sweeping purposes.

As best seen in FIGS. 4, 6 and 7, I provide a simple height adjustment to permit continued use of the sweeper as the bristles 110 of the brush 36 begin to wear. At the right side of the sweeper (as viewed from the front) I show the right adjustable arm 106 connected to the inner leg 54 of the bent strut 46 by means of a non-turning carriage type bolt 112. A knurled slipproof washer 114 or other suitable device overfits the carriage bolt 112 and is interposed between the adjustable arm 106 and the inner leg 54 of the bent strut 46. A nut 116 threadedly engages the bolt 112 and can be conventionally tightened thereon. By loosening the nut 116, the rotative position of the adjustable arm can be easily adjusted to accommodate the length of the brush bristles 110. When the brush 36 is new and the bristles are longer, the arm 106 may be horizontally oriented (FIG. 6) so that the brush periphery sweeps over the ground surface 18. When the bristles wear, the arm 106 can be rotated downwardly in the direction of the arrow 118 until proper height adjustment of the brush is achieved. When the desired position is reached, the nut 116 is then tightened on the bolt 122 to lock the arm 106 in proper rotative position. It will be noted that the teeth of the pinion gear mesh with the internal teeth 90 of the brush gear in all rotative positions of the arm 106 inasmuch as the distance between the brush shaft 106 and the bolt 112 remains constant.

At the left side of the modified brush 36' (FIG. 9), as viewed from the front, the height adjustment can be easily made by employing a height adjustment link 120. It will be noted that the left end 109 of the brush shaft 104' is rotatively carried by the left adjustable arm 107 and this arm in turn is stationarily affixed to the inner leg 54 of the left bent strut 46. The arm 107 extends forwardly of the brush shaft 104' to provide an arm extension 122 which forwardly carries an adjustment bolt and nut assembly 124. The height adjustment link 120 is upwardly formed to provide an elongated slot 126 which receives a portion of the bolt and nut assembly 124 therein. The lower end of the link 120 mounts the height adjustment wheel 128 for surface 18 contacting purposes to support the left end of the brush shaft 104'. Vertical adjustment of the height of the brush shaft 104' at its left end 109 can be easily accomplished by first loosening the nut and bolt assembly 124 and moving the link 120 until the desired wheel 128 height is established. Then the nut and bolt assembly 124 is tightened to lock the assembly over the arm 120 at the elongated slot 126 thereof.

Figure 8:
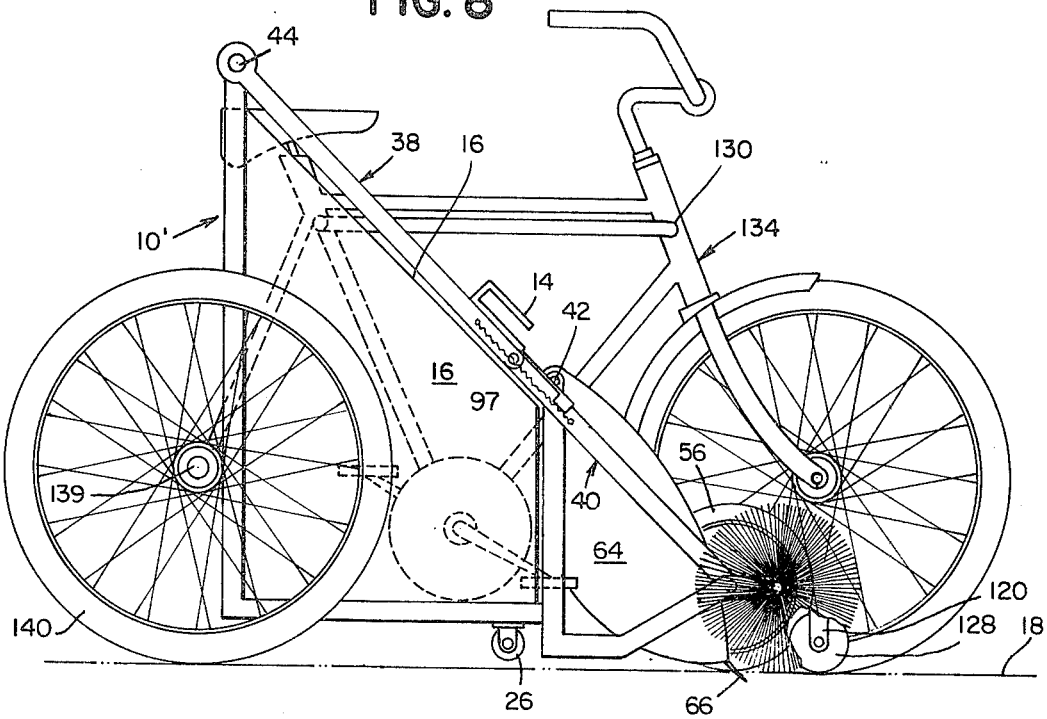
FIG. 8 is a side elevational view of a modified sweeper which employs bicycle motive power.
Figure 9:
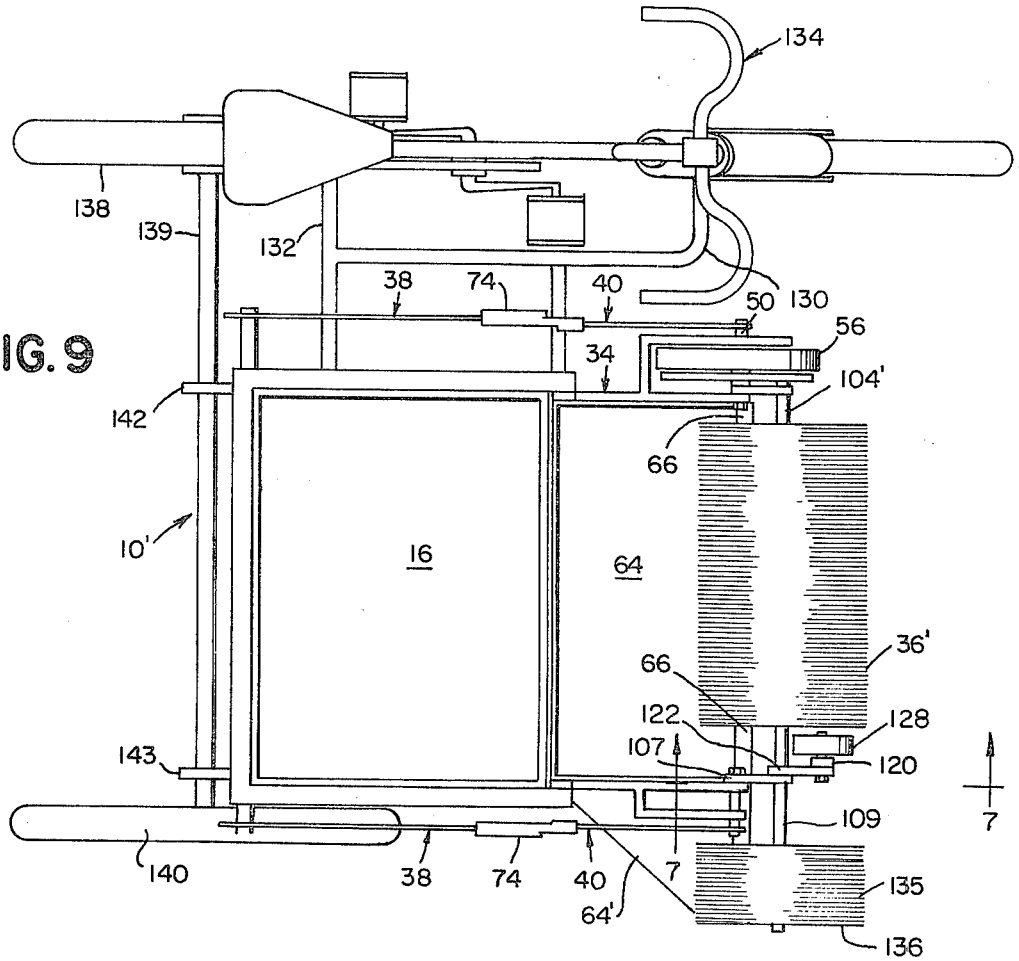
FIG. 9 is a top plan view of the modified sweeper of FIG. 8.

Referring now to FIGS. 8 and 9, I show a modified sweeper 10' which is constructed similarly to the sweeper 10 with the exception that the handle 30 can be eliminated. A pair of front and rear supports 130, 132 laterally extend from portions of the carriage in well known manner and connect to a wheeled vehicle 134 such as a bicycle. In this manner, vehicular power such as can be generated in a bicycle, can be employed to urge the carriage 10' over a surface 18. It is contemplated that such a system will enable a single workman to greatly speed up the sweeping operation and thereby become even more productive. It will be observed that this increased productivity can be achieved without the use of fuel powered motors and their associated drawbacks of noise, air pollution, fuel costs and consumption of natural resources. In the embodiment illustrated, an axle 139 extends from the hub of the rear bicycle wheel 138 and extends laterally across the modified vehicle 10'. A large wheel 140 connects at the lateral end of the axle 139 and serves to help carry the weight. It will be appreciated that the wheel 140 could easily be designed to be driven by having the axle 139 rotate with the wheel 138 or else, the axle 139 could be fixed and the wheel 140 could be rotated thereabout. Supports 142, 143 suspend the rear of the modified vehicle 10' from the axle 139. If the axle 139 is designed for rotation, suitable bearings (not shown) can be applied at the supports 142, 143.

A modified brush 36' is illustrated in FIG. 9 wherein a lateral brush extension 135 is employed to enable the device to sweep into hard to reach places such as along side of curbs or building walls. The modified brush 36' may be employed with equal facility with either the worker propelled sweeper 10 of FIGS. 1–3 or with the bicycle propelled sweeper 10' as illustrated in FIGS. 8 and 9.

In the embodiment illustrated, the modified brush shaft 104' extends laterally exteriorly of the left adjustable arm 107 to receive a brush extension 135 thereon. The brush extension 135 is fabricated similarly to the brush 36 and extends laterally a sufficient distance to project beyond all structure of the sweeper. In this manner, the left lateral side 136 of the brush extension 135 can be directed against curbs, building walls and similar vertical constructions (not shown) to allow a sweeper 10, 10' to clean in close proximity to the vertical construction. In this regard, it is noteworthy that the modified brush 36' and particularly the brush extension 135 rotate about a horizontal brush shaft 104' and that no vertical brush shaft is employed. A modified hopper 64' extends laterally and is positioned behind the brush extension 135 in this modification to receive the debris as it is swept by the brush extension.

Although I have described the present invention with reference to the particular embodiments therein set forth, it is understood that the present disclosure has been made only by way of example and that numerous changes in the details of construction may be resorted to without departing from the spirit and scope of the invention. Thus, the scope of the invention should not be limited to the foregoing specification but rather only by the scope of the claims appended hereto.

I claim:

1. In a sweeper, the combination of

A. a frame having front and rear portions capable of being moved over a surface,
   1. said frame defining a trash container receiving area;

B. a support connected to a front portion of the frame by pivot means,
   1. said support rotatively carrying a surface sweeping brush,
   2. said support having means to move the brush from a surface sweeping position to an elevated position between the front pivotal connection and the rear of the frame, and C. a hopper carried by the support and positioned to receive sweepings from the brush,
   1. said hopper including means to dump the hopper to transfer the sweepings from the hopper to the trash container receiving area.

2. The sweeper of claim 1 wherein the means to dump the hopper includes pivotal means connected to the support.

3. The sweeper of claim 1 and a removable trash container placed in the trash container receiving area.

4. The sweeper of claim 1 wherein the pivotal means moves the hopper to transfer the sweepings from the hopper to the trash container receiving area.

5. The sweeper of claim 4 wherein a portion of the hopper is vertically positioned above a portion of the trash container receiving area when the hopper is moved to transfer the sweepings.

6. The sweeper of claim 1 and a lateral support extending from the frame, said lateral support being connected to a wheeled vehicle.

7. The sweeper of claim 6 wherein the wheeled vehicle is a bicycle.

8. The sweeper of claim 1 wherein the pivotal means include a pair of pivotally interconnected struts and a surface contacting wheel, said wheel rotating the brush when the wheel is rolled over the surface.

9. The sweeper of claim 8 wherein the struts are in contracted relationship when the brush is in the elevated position and in extended relationship when the brush is in surface sweeping position.

10. The sweeper of claim 9 wherein the frame includes a forward wheel and a rearward wheel, said forward wheel not contacting the surface when the struts are in extended relationship.

11. The sweeper of claim 9 wherein the frame includes a forward wheel and a rearward wheel, said forward wheel contacting the surface when the struts are in contracted relationship.

12. The sweeper of claim 1 wherein the brush rotates about a horizontal shaft, the said shaft receiving rotary power from a surface contacting wheel, said wheel being rotatively carried by the support.

13. The sweeper of claim 10 wherein the brush and shaft extends laterally outwardly beyond the wheel.

14. The sweeper of claim 11 wherein the shaft extension is horizontally positioned and wherein the brush extension rotates about a horizontal axis.

15. The sweeper of claim 10 wherein a gear drive transmits rotary power from the surface contacting wheel to the brush shaft.

16. The sweeper of claim 15 wherein the gear drive includes a brush gear interconnected to the wheel and a pinion gear in mesh with the brush gear, the pinion gear rotatively driving the brush shaft.

17. The sweeper of claim 16 wherein the brush gear is of the internal tooth type.

18. The sweeper of claim 16 wherein the interconnection between the brush gear and the wheel includes means to prevent rotation of the brush shaft in one direction.

19. The sweeper of claim 18 wherein the means include a rachet connection.

20. The sweeper of claim 19 wherein the rachet connection includes at least one pin projecting from the wheel and a rachet lever pivotally connected to the brush gear, said rachet lever locking upon the pin when the brush is forwardly moved over the surface, said ratchet lever passing by the pin when the brush is backwardly moved over the surface.

21. The sweeper of claim 16 and means to adjust the height of the brush shaft relative to the surface, said means to adjust being independent of the frame.

22. The sweeper of claim 21 wherein the means to adjust include an adjustable arm within which the brush shaft is journalled, said adjustable arm being capable of rotary adjustment relative to the brush gear.

23. The sweeper of claim 22 and means to lock the adjustable arm in any desired rotary position relative to the brush gear, whereby the height of the brush shaft above the surface can be varied.

24. The sweeper of claim 15 wherein the frame is sefl-standing on the said forward and rearward wheels when the struts are in contracted relationship.

* * * * *